United States Patent [19]

Gilvydis

[11] Patent Number: 4,524,674

[45] Date of Patent: Jun. 25, 1985

[54] MILITARY VEHICLES

[75] Inventor: Jaunutis B. Gilvydis, Oakland County, Mich.

[73] Assignee: The Unites States of America as represented by the Secretary of the Army, Washington, D.C.

[21] Appl. No.: 460,323

[22] Filed: Jan. 24, 1983

[51] Int. Cl.[3] ..... F41H 5/00

[52] U.S. Cl. ..... 89/36 H

[58] Field of Search ..... 89/36 H, 36 K, 40 B

[56] References Cited

U.S. PATENT DOCUMENTS

| | | | |
|---|---|---|---|
| 3,608,426 | 9/1971 | Jackson . | |
| 4,065,999 | 1/1978 | Hultgren et al. | 89/36 H |
| 4,262,596 | 4/1981 | Allier et al. . | |
| 4,326,446 | 4/1982 | Magnuson | 89/40 B |
| 4,454,799 | 6/1984 | Gilvydis | 89/47 |

*Primary Examiner*—Harold J. Tudor

*Attorney, Agent, or Firm*—Peter A. Taucher; John E. McRae; Robert P. Gibson

[57] ABSTRACT

Add-on armor protection for a military tank having an externally mounted main gun. Horizontal armor plates are attached to existing upstanding gun cradle wall structure to provide enhanced protection for the driver and commander; an additional armor plate can be mounted at the rear ends of the gun cradle wall structure to protect ammunition stored in rear areas of the hull. The add-on armor components are particularly designed to protect against top attack munitions. Some or all of the armor components can be swingably adjustable to provide alternate protection against enemy ground fire attack.

14 Claims, 9 Drawing Figures

MILITARY VEHICLES

GOVERNMENT INTEREST

The invention described herein may be manufactured, used, and licensed by or for the Government for governmental purposes without payment to me of any royalty thereon.

BACKGROUND AND SUMMARY

This invention relates to military vehicles, especially tanks. A primary aim of the invention is to increase armor protection for humans and stored ammunition within the vehicle, particularly against overhead threats such as helicopter fire, aircraft strafing attack, enemy mortar fire, or guided missile attack. U.S. Pat. No. 3,608,426 to Jackson and U.S. Pat. No. 4,262,596 to Allier et al describe overhead threats of special concern.

This invention arises particularly because of recent attempts by military designers to reduce tank weight and to lower the tank silhouette (target height). Such attempts involve removal of the usual armored turret from the vehicle, and mounting the main gun in an external exposed location atop a platform that rotates in the plane of the hull roof. The new "externally mounted gun" type tanks provide a significant weight saving and reduction in vehicle profile area (especially in the vertical direction).

The conventional turret heretofore employed usually includes a bustle at its rear end that overhangs the area of the hull in which ammunition is stored; some ammunition is also stored in the turret bustle. The recent action in removing the turret requires that all ammunition be stored in the hull; size of the storage area is increased. Since the bustle no longer overhangs the ammunition storage area there is lessened armor protection against explosion of ammunition due to enemy overhead attack.

The forward area of the conventional turret has an overhang portion that tends to partially protect the human driver and other humans in the hull area forward from the turret basket. Removal of the turret from the vehicle leaves the driver and other humans vulnerable to overhead enemy attack.

The present invention is concerned with so-called "externally mounted gun" tanks. A special aim is to increase the armor protection level for the crew and ammunition compartments in such tanks. The inventive concept provides overhead protection against so-called "top attack" munitions; an armor umbrella covers both the crew and ammunition compartments. In its simplest form the umbrella comprises horizontal armor plates affixed to the gun cradle walls about eighteen inches above the hull roof (or at any reasonable height that is required or attainable). The plates extend outwardly from the gun cradle walls to provide spaced armor protection for selected areas of the hull, especially the crew stations and ammunition magazine(s). An object of the invention is to provide overhead protection for an externally mounted gun tank at relatively low cost and added vehicle weight. Another object is to provide overhead protection without significantly increasing the vehicle profile area exposed to enemy ground observation and/or enemy ground fire; this is accomplished by disposing the armor plates horizontally so that only the edge areas of the plates are viewable by the enemy ground force.

In its more costly implementation the invention contemplates that some of the armor plates are foldable or swingable into upright attitudes when overhead protection is not necessary, i.e. when the enemy force is known to lack significant overhead threat capability. The foldable plates are designed so that when they assume upright attitudes they are spaced outwardly from the gun cradle walls to provide standoff protection against enemy ground fire that might pierce or deform the gun cradle walls sufficiently to make the gun inoperable.

Preferably the add-on armor plates of this invention are positioned so that the human driver and commander are protected without interferring with potential crew operation under hatch-open conditions, i.e. with the driver or commander having his head projecting upwardly through the respective hatch openings to view the terrain directly rather than through vision blocks (periscopes).

In an optimum configuration some of the armor plates are adjustable to emergency non-obstruct positions at least partially removed from the spaces above the hatch openings. This arrangement is particularly advantageous should it become necessary for the humans to very guickly exit from the vehicle through the hatch openings, i.e. when enemy fire has disabled the vehicle into a burning or potentially exploding condition.

THE DRAWINGS

Figure 2:
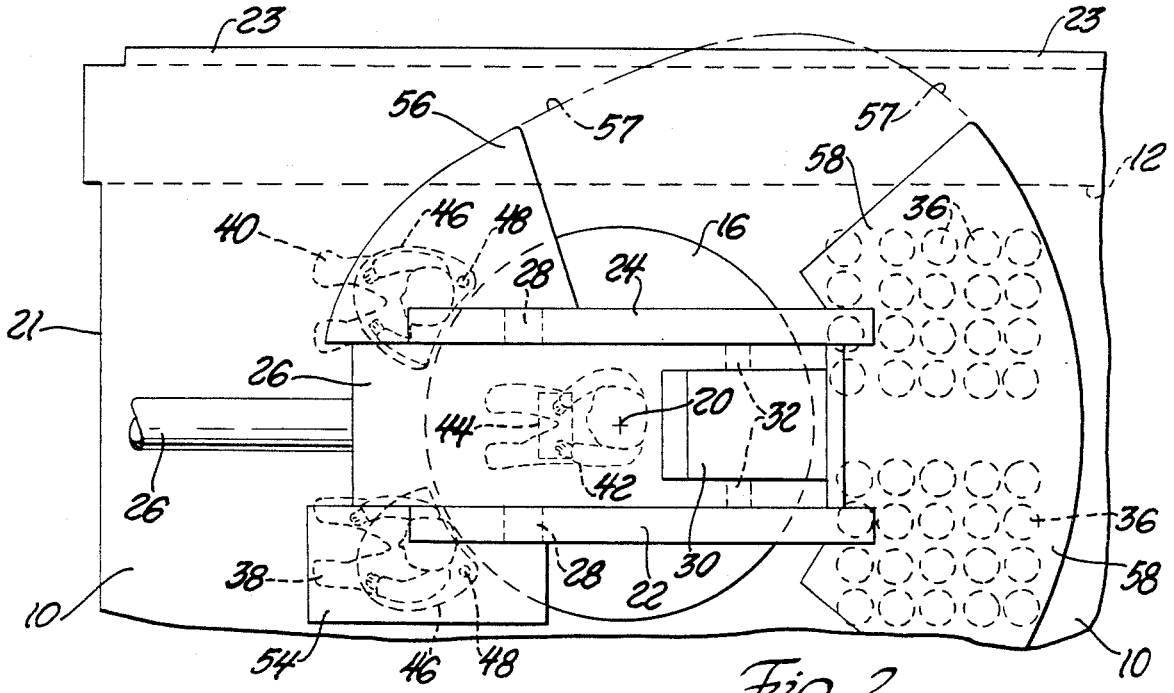
FIG. 2 is a top plan view of the FIG. 1 tank.
Figure 1:
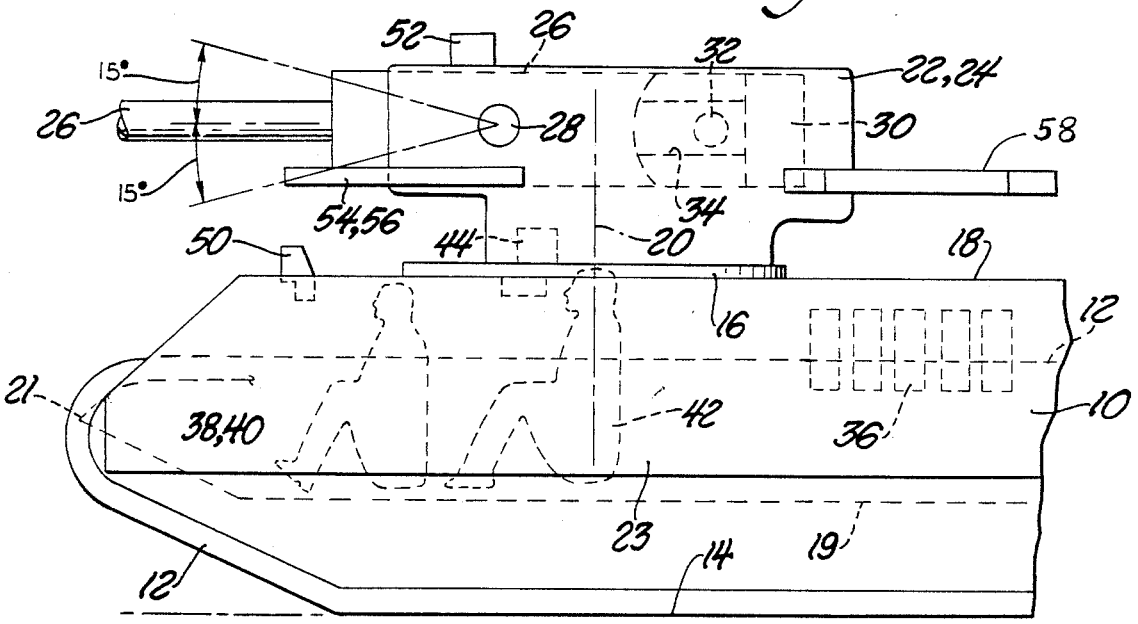
FIG. 1 is a side elevation view of a tank embodying my invention.

Referring in greater detail to FIGS. 1 and 2, there is shown an existing military vehicle that comprises a hull 10 supported on ground-engagement tracks 12 for motion over terrain surface 14. The hull includes a roof wall 18, bottom wall 19, and front nose section 21. Armor skirt plates 23 are hung on the hull outside tracks 12 to provide additional armor protection for the crew and ammunition compartments as well as for the tracks, wheels and road arms. The rear portion of the vehicle containing the engine and transmission is not shown.

The tank is a so-called "externally mounted gun tank" wherein the main gun is mounted on a circular platform or table 16 that is disposed in a circular opening in the hull roof 18 for azimuth rotation around its central axis 20; motor-ring gear mechanism, not shown, powers platform 16 for three hundred sixty degree rotation around axis 20. Two parallel walls 22 and 24 project upwardly from platform 16 to define a cradle for a main gun 26 of a size suited to the vehicle's military purpose;

a gun of 105 mm or 120 mm size is presently contemplated. Pivot or trunnion means 28 mounts the gun for movements in the elevational plane around a pivot axis transverse to cradle walls 22 and 24. The gun is shown in its forward-fire position. Movement of platform 16 around axis 20 enables the gun to fire in other directions, e.g. rearwardly, to the right, to the left, etc. The gun is provided with a breech 30 swingable counterclockwise around pivots 32 to permit live rounds of ammunition to be rammed upwardly through an opening in platform 16 into firing chamber 34 of the gun. Reserve rounds of ammunition are stored in magazine areas 36 within hull 10, as described generally in my co-pending U.S. patent application, Ser. No. 382,038, filed May 26, 1982 now U.S. Pat. No. 4,454,799.

The illustrated vehicle is operated by a three man crew consisting of a human driver 38, commander 40, and gunner 42. Preferably an automatic ammunition loader is provided in the area beneath platform 16, thus enabling the gunner to devote his full attention to his primary mission, i.e. locating, tracking and firing on enemy targets. A range finder and television camera, optical tracker or other sighting mechanism 44 is located on platform 16 (or elsewhere on the gun cradle) to facilitate target acquisition and firing while the vehicle is moving or stationary.

As best seen in FIG. 2, the hull roof areas above the commander's station and driver's station are equipped with hatch opening closures 46 of generally semi-circular plan outline. Each closure 46 is swingable horizontally on a vertical pivot 48 to enable the soldier to project his head upwardly through the hatch opening to view the terrain directly, rather than through the conventional periscopes 50 (FIG. 1). Thus, with the hatch opening closed the soldier views the area in front of, or to the side of, the vehicle through conventional periscopes 50; with the hatch open the soldier can shift his head upwardly so that at least his eyes are above the plane of the hull roof 18, to obtain a clearer or more comprehensive view of the terrain. A television camera 52 may be swivel-mounted on cradle wall 24 to permit the commander a full view of the terrain. A television receiver, not shown, would be provided at the commander's station.

My invention is concerned with add-on armor plates attached to gun cradle walls 22 and 24 to protect commander 40, driver 38, and ammunition magazine compartment 36 from overhead enemy attack. As best seen in FIG. 2, the protection means comprises a first armor plate 54 overlying the driver station, a second armor plate 56 overlying the commander station, and a third armor plate 58 overlying the ammunition magazine 36; each plate is relatively thick e.g. two or more inches, for achieving significant resistance to enemy projectile penetration or destruction. Armor plate material can be varied or changed according to periodic technological advances in armor materials or enemy projectiles, e.g. armor piercing, directional explosives, shaped charge enhancement, etc. The plates are spaced considerable distances above hull roof 18, e.g. eighteen inches, to cooperate with the hull roof plate in defining a spaced armor obstruction to the downwardly directed enemy projectiles. Each plate 54, 56 or 58 may be on the same elevational plane, i.e. the same distance above hull roof 18, to minimize the plate edge profile viewed by the enemy ground force; a small target area in the azimuth plane somewhat minimizes possibility of detection and/or enemy fire damage.

FIG. 2 shows the gun in its forward-fire position. When platform 16 is rotated to the left or right the armor plates 54, 56 and 58 may only partially protect the driver, commander and ammunition storage area from overhead attack. Complete continuous protection can be achieved by connecting plate 58 to each plate 54 or 56 via a fill-in plate. FIG. 2 shows with dashed lines 57 the peripheral edge shape that one such fill-in plate might have to achieve a C-shaped wall providing continuous overhead protection in all positions of platform 16.

The various armor plates 54, 56 and 58 can have varying plan shapes, dependent on the shapes, sizes and locations needing protection. For illustration purposes plate 54 is shown as generally rectangular, and plate 56 is shown as segmental. Plate 56 provides somewhat greater protection than plate 54 but with greater weight expenditure. In an actual tank plates 54 and 56 would probably be of the same plan outline to provide the same level of protection for the two soldiers 38 and 40. Alternatively the plate structures would be combined into a unitary C-shaped plate assembly as outlined above.

Armor plates 54, 56 and 58 are welded or otherwise attached to cradle walls 22 and 24. It would be possible to mount the plates on the hull in upwardly spaced relation to hull roof 18. However, the armor-hull roof spacing would need to be reduced considerably in order that the plates would not be impacted by the gun when it is at a negative elevation. It is preferred to mount plates 54, 56 and 58 on the gun cradle walls rather than on hull 10 in order to achieve a greater "spaced armor" action. A greater plate-armor spacing also is desired for achievement of maximum vertical clearance or free space above the openings closed by hatch covers 46, 46. A large free space is desired in order to permit the driver or commander to view the terrain through the open hatch, and to permit emergency escape from the vehicle when or if the vehicle is disabled, on fire, or in danger of exploding.

Figure 3:
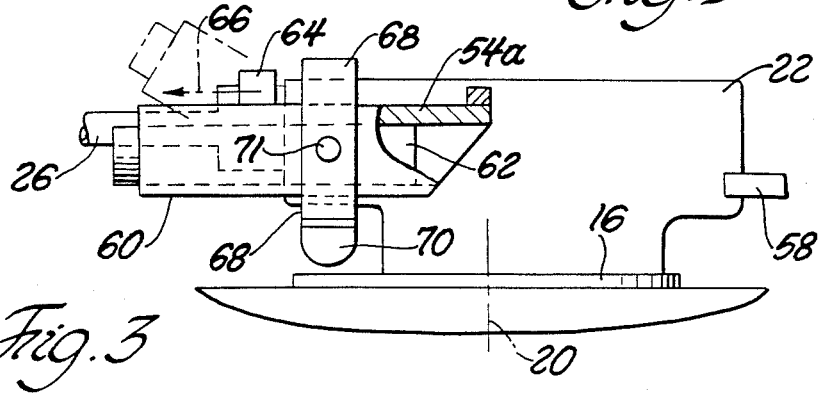
FIG. 3 is a fragmentary view similar to FIG. 1, but illustrating another embodiment of my invention wherein an add-on armor of my plate is utilized to support an air defense weapon, i.e. a missile launcher.

FIG. 3 fragmentarily shows an add-on armor plate similar to plate 54 except that it is incorporated as part of a missile launcher used for air defense or anti-tank attack purposes. As shown in FIG. 3, armor plate **54*a* forms the roof of a swingable housing 60 employed to mount and protect one or two missile launchers 62. The missile can be any known missile within size and space limitations of the system. Contemplated missiles are the chaparrel (an optically-tracked, heat-seeking missile) and the stinger (an optically-sighted laser beam-rider missile). A target-sighting and/or target-tracking camera means 64 may be positioned on armor plate 54*a* to sight the target along sight line 66**.

Missile launcher housing 60 may be swingably mounted in a yoke or frame 68 that is welded or otherwise firmly attached to cradle wall 22. A motor 70 is located on the undersurface of frame 68 to power housing 60 for swinging movement around housing pivot means 71. A suitable gear-type transmission (not shown) may be used to transmit motor shaft rotation to the pivot shafts 71, for thus moving the missile launcher and attached sight to a desired inclination suitable for acquiring and tracking an enemy aircraft or missile. Sighting/tracking in the azimuth plane is accomplished by rotating platform 16 around central axis 20.

When the missile launcher is in an inclined attitude, as shown in dotted lines in FIG. 3, there is an increased vertical free space between housing 60 and the subjacent hatch opening for the driver station. This feature permits the driver to achieve quick emergency escape from the vehicle without striking his head or shoulders on the housing 60 lower surface. Armor plate 54*a* provides overhead protection for the missile launcher and also for the driver in hull 10. The FIG. 3 system may be duplicated at the commander station if desired.

Figure 4:
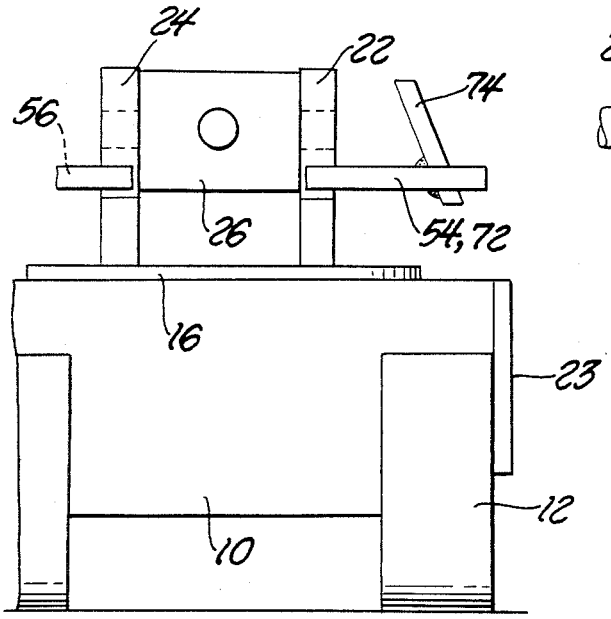
FIGS. 4 and 5 are fragmentary front and side elevational views of a tank utilizing a further embodiment of the invention that includes standoff armor protection for the main gun against enemy ground fire.
Figure 5:
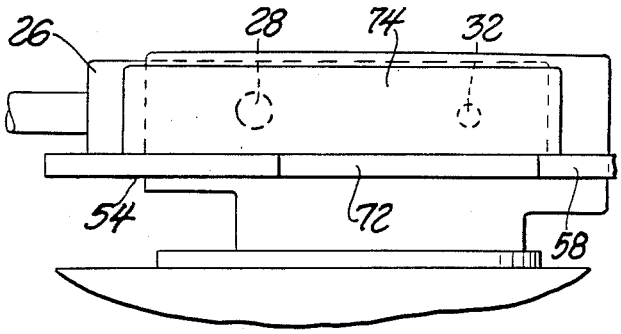

FIGS. 4 and 5 illustrate a rigid armor arrangement generally along the lines of FIG. 1. In FIGS. 4 and 5 the armor plate 54 over the drivers station is joined to the armor plate 58 by means of an intervening fill-in plate or plate section 72. An additional upstanding armor plate 74 is welded to the horizontal plate to provide spaced armor protection against enemy ground fire directed toward main gun 26. Plate 74 may be slightly tilted in an inboard direction to increase the effective plate thickness and to achieve some projectile deflection effects. The structure of FIGS. 4 and 5 may be duplicated at the commander's side of the vehicle.

Figure 6:
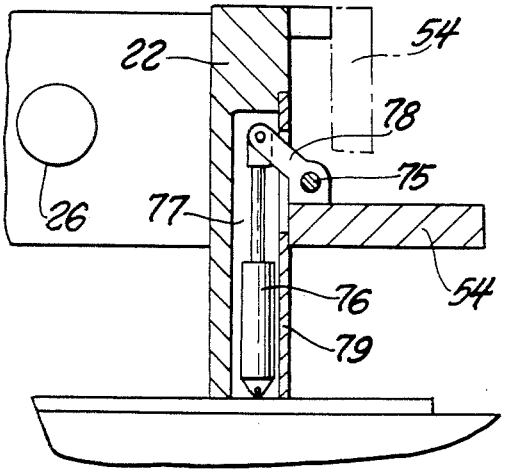

FIG. 6 illustrates mechanism for adjusting armor plate 54 from its normal horizontal position to an upright position parallel to the associated gun cradle wall 22. In this case plate 54 is swingable on a pivot shaft 75 that is mounted on wall 22 via nonillustrated ears or lugs. A fluid cylinder 76 is located in cavity 77 in wall 22 to act on arm 78 carried by wall 54, whereby introduction of pressure fluid into the upper end of cylinder 76 moves plate 54 from its horizontal attitude to an upright position spaced from wall 22. Cavity 77 may be closed by an elongated cover 79. Plate 54 may extend along the entire length of wall 22 so that when the plate is in its upright position the plate cooperates with wall 22 to provide spaced armor protection against enemy ground attack directed toward gun 26. Adjustment of plate 54 to its upright position would normally be made when the threat of overhead attack is minimal and the threat of ground attack is most pressing. Fluid cylinder 76 would be controlled by valve means operated from the driver station or commander's station. The FIG. 6 system may be used on either or both sides of the vehicle.

Figure 7:
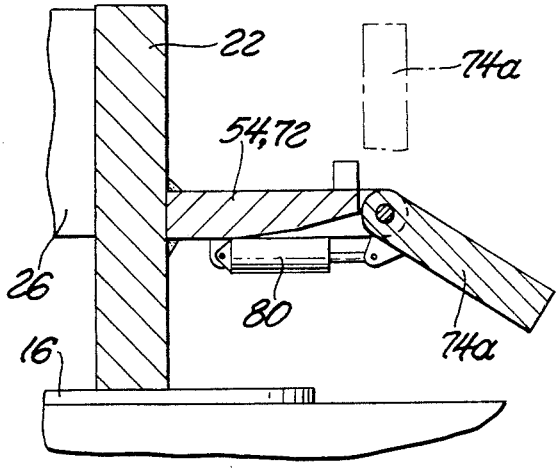
FIGS. 6 and 7 are fragmentary sectional views of tanks utilizing "foldable" armor forms of the invention.

FIG. 7 illustrates a system that includes armor plates 54 and 72 constructed similarly to plates 54 and 72 in FIG. 4. In this case however the additional armor plate 74*a* is swingably mounted on plate 72 for adjusting motion between an upright attitude (dashed lines) and a slightly declined attitude. A fluid cylinder 80 is positioned in or beneath wall 72 to operate plate 74*a* between its two positions of adjustment. Plate 74*a* is positioned in its full line position when it is desired to minimize the imaginary "entrance window" for enemy projectiles from shallow angle flying top attack munitions. Plate 74*a* is positioned in its upright position (dashed lines) when it is desired to provide extra flank protection for the main gun against ground forces attack.

Figure 8:
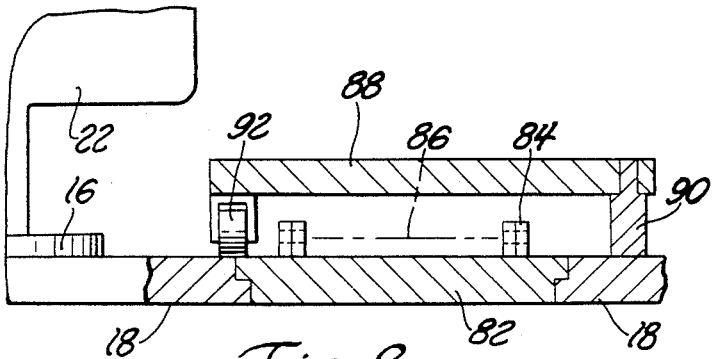
FIG. 8 illustrates a variant of the general concept wherein an armor plate is carried by the hull rather than the gun cradle walls.

FIG. 8 illustrates a method for achieving spaced armor protection for ammunition stored in the hull behind platform 16. Such ammunition is initially downloaded into the hull through two (or more) hatch openings closed by armored closures; one such closure is shown at 82 in FIG. 8. The closure is swingable in a plane normal to the plane of the paper about hinge elements 84 that define a swing axis 86. Add-on armor protection for closure 82 is provided by an armor plate 88. To gain access to closure 82 it is necessary to move plate 88 aside. The plate is swingable in a horizontal plane around an upstanding post 90 welded to hull roof 18. Two or more rollers 92 are carried by plate 88 to support it in spaced relation to roof 18. It may be possible to use the FIG. 8 armor mount system for the spaces above the hatch openings at the driver's station and commander's station. FIG. 8 represents a hull-mounted armor system that may be feasible in certain situations. The more preferred arrangements utilize gun cradle-mounted armor systems, shown in FIGS. 1 through 7.

Figure 9:
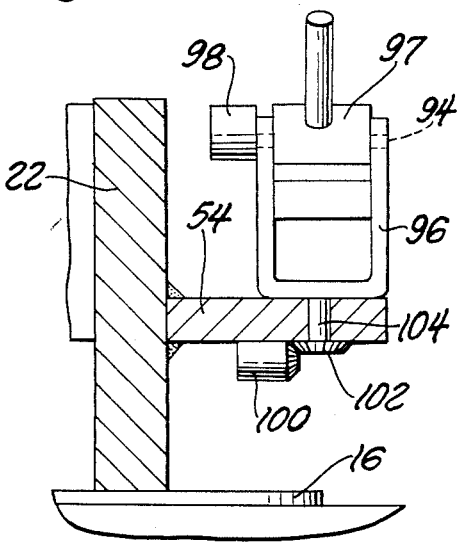
FIG. 9 illustrates a form of the invention wherein an add-on armor plate is used to support an anti-aircraft weapon, e.e. a twenty milimeter rapid fire gun.

FIG. 9 illustrates an arrangement wherein add-on armor plate 54 is used to mount an air defense weapon, e.g. a 20 mm rapid fire gun. The gun 97 is swingable in the elevational plane around pivot pins 94 extending into an upstanding yoke 96. A motor 98 provides motive force for gun elevational adjustments. Azimuth adjustment is provided by a motor 100 carried on the undersurface of plate 54. Gear means 102 transmits motor 100 rotation to a vertical shaft 104 carried by yoke 96. Motors 98 and 100 would be remotely controlled from the commander's station.

FIGS. 3 and 9 are intended to show generally how the add-on armor system of my invention can be used to support an air defense weapon. My invention is concerned primarily with the add-on armor system per se. FIGS. 1 and 2 illustrate the primary inventive concept. FIGS. 6 and 7 illustrate optional adjustability features that can be used to convert the armor plates from an air defense mode to a ground defense mode.

I wish it to be understood that I do not desire to be limited to the exact details of construction shown and described for obvious modifications will occur to a person skilled in the art, without departing from the spirit and scope of the appended claims.

I claim:

1. In a military vehicle that comprises a hull having a roof, a platform disposed on the roof for rotary motion in the azimuth plane, two parallel walls projecting upwardly from the platform to define a gun cradle; a main gun located within the defined cradle; pivot means supporting the gun for adjusting movements in the elevational plane around a pivot axis transverse to the cradle walls; two personnel stations within the hull forwardly from the platform; and ammunition storage magazine means within the hull rearwardly from the platform: the improvement comprising means for protecting the personnel stations and magazine means from overhead attack; said protecting means comprising first, second and third armor plates carried by the cradle walls an appreciable distance above the hull roof; each armor plate being essentially horizontal when the vehicle is on level ground; a first one of the armor plates overlying one of the personnel stations when the platform is in a forward-fire position; a second one of the armor plates overlying the other personnel station when the platform is in a forward-fire position; a third one of the armor plates overlying the magazine means when the platform is in a forward-fire position.

2. The improvement of claim 1; said first armor plate extending forwardly and laterally outwardly from one of the cradle walls; said second armor plate extending forwardly and laterally outwardly from the other cradle wall; said third armor plate extending rearwardly from both cradle walls.

3. The improvement of claim 1, and further comprising means for adjusting each of said first and second armor plates from the horizontal position to an upright position parallel to the associated gun cradle wall.

4. The improvement of claim 3, wherein each adjusting means comprises a fluid cylinder.

5. The improvement of claim 4; each fluid cylinder being located in an upright attitude within one of the gun cradle walls; each of said first and second armor plates being pivotally attached to the associated gun cradle wall so that when the plate is in its upright position it is spaced from the gun cradle wall.

6. The improvement of claim 1, and further comprising an air defense weapon mounted on at least one of said first and second armor plates.

7. The improvement of claim 6, said one armor plate being swingably attached to the associated gun cradle wall for adjustment of the weapon in the elevational plane.

8. The improvement of claim 1, said vehicle having a hatch opening in the hull roof area above each personnel station, each hatch opening being sized to permit human escape from the personnel station, and a closure for each hatch opening; each of the armor plates associated with a personnel station being spaced above the hatch opening a sufficient distance to permit a soldier to extend his head through the opening without striking the overhead armor plate.

9. The improvement of claim 8, each of said first and second armor plates being swingably attached to the associated gun cradle wall for movement from its horizontal position overlying the associated hatch opening to a non-horizontal position at least partly exposing the hatch opening to the space above the armor plate horizontal plane, whereby the soldier has an escape path through the hatch opening when the plate is swung to its non-horizontal position.

10. The improvement of claim 1, each armor plate being located approximately eighteen inches above the hull roof.

11. The improvement of claim 1, and further comprising a first fill-in armor plate between the first and third armor plates, and a second fill-in armor plate between the second and third armor plates, the various armor plates being on the same horizontal plane for collectively forming a continuous C-shaped plate structure extending along and behind the two cradle walls.

12. The improvement of claim 1, wherein the armor plates are affixed to the gun cradle walls by weld-type connections.

13. In a military vehicle that comprises a hull having a roof, a platform disposed on the roof for rotary motion in the azimuth plane, two parallel walls projecting upwardly from the platform to define a gun cradle; a main gun located within the defined cradle; pivot means supporting the gun for adjusting movements in the elevational plane around a pivot axis transverse to the cradle walls; two personnel stations within the hull forwardly from the platform; a hatch opening in the hull roof area above each personnel station, each hatch opening being sized to permit human escape from the personnel station; and ammunition storage magazine means within the hull rearwardly from the platform: the improvement comprising means for protecting the personnel stations and magazine means from overhead attack; said protecting means comprising horizontal armor plate means of c-shaped plan outline carried by the cradle walls an appreciable distance above the hull roof; said armor plane means comprising a first armor plate section overlying one of the personnel stations when the platform is in a forward-fire position, a second armor plate section overlying the other personnel station when the platform is in a forward-fire position, and a third armor plate section overlying the magazine means when the platform is in a forward-fire position;

said first armor plate section extending forwardly and laterally outwardly from one of the cradle walls; said second armor plate section extending forwardly and laterally outwardly from the other cradle wall; said third armor plate section extending rearwardly from both cradle walls; said horizontal armor plate means occupying a single horizontal plane a sufficient distance above the hull roof to permit a soldier at a personnel station to extend his head upwardly through a hatch opening without striking the overhead armor plate means.

14. The improvement of claim 13, said horizontal armor plate means being located approximately eighteen inches above the hull roof.

* * * * *